US006910582B2

(12) United States Patent
Lantz

(10) Patent No.: US 6,910,582 B2
(45) Date of Patent: Jun. 28, 2005

(54) SHOCK ABSORBING INSULATED SHIPPING CONTAINER ESPECIALLY FOR BREAKABLE GLASS BOTTLES

(76) Inventor: Gary W. Lantz, 24282 Lysanda Dr., Mission Viejo, CA (US) 92691

( * ) Notice: Subject to any disclaimer, the term of this patent is extended or adjusted under 35 U.S.C. 154(b) by 10 days.

(21) Appl. No.: 10/152,912

(22) Filed: May 22, 2002

(65) Prior Publication Data

US 2003/0217948 A1 Nov. 27, 2003

(51) Int. Cl.[7] ..... B65D 81/02
(52) U.S. Cl. ..... 206/593; 206/438
(58) Field of Search ..... 206/591–594, 206/363, 438, 427, 433, 434; 229/120.36, 120.37

(56) References Cited

U.S. PATENT DOCUMENTS 3,038,625 A * 6/1962 Sinner et al. ..... 229/120.36
3,039,667 A * 6/1962 Kozlik ..... 229/120.36
3,421,679 A * 1/1969 Goldman ..... 229/120.36
4,094,454 A * 6/1978 Snyder ..... 229/120.36
4,187,975 A * 2/1980 Shepherd ..... 229/120.36
5,042,260 A * 8/1991 George, Sr. ..... 229/120.36
5,190,212 A * 3/1993 Morris ..... 229/120.29
5,322,181 A * 6/1994 Nelson ..... 220/461
5,597,113 A * 1/1997 Bradford ..... 229/120.36
5,626,284 A * 5/1997 Franzen ..... 229/120.36
5,785,239 A * 7/1998 Campbell, II et al. .. 229/120.36
6,345,719 B1 * 2/2002 Jaycox ..... 260/570
6,536,654 B2 * 3/2003 Reynolds et al. ..... 229/130.11

* cited by examiner

*Primary Examiner*—Shian T. Luong
(74) *Attorney, Agent, or Firm*—Terry L. Miller

(57) ABSTRACT

An improved shock absorbing insulated shipping container including an external corrugated cardboard box, receiving an insulated body having a cavity for holding a one or more breakable glass bottles, which bottles may contain high value liquid product being shipped, such as medicine or wine, and also receiving an especially configured and constructed, shock-absorbing filling structure or partition system for separating the glass bottles from one another, and from one or more receptacle cavities for holding phase change coolant or temperature control material in a predetermined relationship to the glass bottles. The container also includes an insulating and cushioning cover adapted to engage into a top opening of the insulated body after the bottles and coolant are received in the cavity thereof. The insulated body is preferably formed from injection molded polyurethane, wrapped in a plastic film.

9 Claims, 4 Drawing Sheets

SHOCK ABSORBING INSULATED SHIPPING CONTAINER ESPECIALLY FOR BREAKABLE GLASS BOTTLES

BACKGROUND OF THE INVENTION

1. Field of the Invention

The present invention relates generally to shipping containers, and more particularly relates to an insulated shipping container for shipping fragile product, such as glass bottles containing a high value liquid material, such as medicine or fine wine, for example, and which is to be neither frozen or nor allowed to become too warm during transport. The container has a plurality of cavities therein for holding the glass bottles in physical isolation from one another, as well as providing a shock absorbing function, while holding and protecting a phase change coolant or warming material contained in flexible plastic packs in heat transfer relation to the bottles. The insulated container is configured and constructed to provide shock absorption, to provide temperature regulation for the contents of the bottles, and to protect the phase change coolant or warming material from shifting of the bottles during shipping, and in a predetermined relationship to the bottles in order to maintain a temperature controlled condition which is neither freezing or too warm, and for an extended period of time during transport by common carrier.

2. Related Technology

Traditionally, containers for shipping temperature sensitive products have generally included conventional cardboard shipping containers having an insulating material therein. The insulating material may be simple loose-fill Styrofoam "peanuts," for example, in which a chunk of dry ice is placed along with the material to be shipped. Another variety of conventional insulated shipping container utilized panels or containers made of an insulating material, such as expanded polystyrene (EPS). EPS is a relatively inexpensive insulating material, and it may be easily formed into a desired shape, has acceptable thermal insulating properties for many shipping needs, and may be encapsulated or faced with protective materials, such as plastic film or metal foil, or plastic film/metal foil laminates.

Containers including EPS are often provided in a modular form. Individual panels of EPS insulation, possibly wrapped in foil or the like, are preformed using conventional methods, typically with beveled edges. The panels are then inserted into a conventional cardboard box type of shipping container, one panel against each wall, to create an insulated cavity within the container. In this arrangement, the beveled edges of adjacent panels form seams at the corners of the container. A product is placed in the cavity and a plug, such as a thick polyether or polyester foam pad, is placed over the top of the product before the container is closed and prepared for shipping. In many cases, a coolant, such as packaged ice, gel packs, or loose dry ice, is placed around the product in the cavity to refrigerate the product during shipping.

Alternatively, an insulated body may be injection molded from expanded polystyrene, forming a cavity therein and having an open top to access the cavity. A product is placed in the cavity, typically along with coolant, and a cover is placed over the open end, such as the foam plug described above or a cover formed from EPS.

For shipping particularly sensitive products, such as certain medical or pharmaceutical products, expanded rigid polyurethane containers are often used, as expanded polyurethane has thermal properties generally superior to EPS. Typically, a cardboard container is provided having a box liner therein, defining a desired insulation space between the liner and the container. Polyurethane foam is injected into the insulation space, substantially filling the space and generally adhering to the container and the liner. The interior of the box liner provides a cavity into which a product and coolant may be placed. A foam plug may be placed over the product, or a lid may be formed from expanded polyurethane, typically having a flat or possibly an inverted top-hat shape.

With conventional shipping containers, the fact that the product and coolant are typically placed together within the cavity in the container, may have several adverse effects. When shipping certain products, it may be desired to refrigerate but not freeze the product. Placing a coolant, such as loose blocks of dry ice, into the cavity against the product may inadvertently freeze and damage the product. Even if held away from the product, the coolant may shift in the cavity during shipping, especially as it melts and shrinks in size, inadvertently contacting the product. In addition, with gel packs, if they become perforated then melted coolant may leak from the pack, possibly creating a mess within the cavity or even contaminating the product being shipped.

Finally, polyurethane containers of the type using two cardboard boxes nested together with polyurethane injected into the space between these boxes may also create a disposal problem. When polyurethane is injected into such a container, it generally adheres substantially to the walls of both the inner and the outer cardboard box. Thus, the cardboard and insulation components may have to be disposed of together, preventing recycling of the container.

Further, when temperature sensitive materials are shipped in winter time, there is a need to prevent low ambient temperatures from freezing the product being shipped.

Especially, the shipping of fine wines by common carrier presents many challenges. The market for fine wines includes considerations not only of the taste of the wine (which must not be frozen or allowed to become too warm, but of the condition of the bottle and even of the label on that bottle. That is, fine wine collectors don't want even the label to be pealed or scuffed on a collector-quality bottle of wine. Of course, old wine bottles themselves are somewhat fragile, because of the weight of the wine and the size of the bottles. Thus, considerable physical protection must be provided to a wine bottle in order to ship it by common carrier. Presently, a heavy weight cardboard box containing a molded Styrofoam filler with cavities specifically configured to receive the wine bottles is commonly used for wine shipment by common carrier. This shipping box has no provisions for temperature regulation of the wine, so that shipments are limited to spring and fall weeks during which ambient temperatures are neither too hot or too cold. That is, shipments of fine wines now are not generally made during summer months or during winter time for fear that the wine will be ruined by being frozen or by becoming too warm during transport.

Accordingly, there is a need for an improved shipping container to maintain temperature sensitive material, such as fine wine and medicines, in a temperature controlled condition which is not freezing or too warm during transport and over an extended period of time.

SUMMARY OF THE INVENTION

The present invention is directed generally to an improved insulated shipping container for shipping a temperature sensitive product in glass bottles in a temperature regulated condition, which is not frozen or too warm, for an extended period of time. The container may also be used in cold weather conditions to prevent an item being shipped from being frozen by low ambient temperatures. Further, the container is to provide physical protection from shipping shocks during transport of the glass bottles, and is to even provide protection against the glass bottles being scuffed or rubbing against one another during transport.

One aspect of the present invention provides a shock absorbing insulated shipping container for transporting a temperature sensitive product in a breakable glass bottle, the container comprising: an external box; an insulated body received into the box and having a cavity defining an opening; a filling structure received into the cavity and defining at least one vertically extending receptacle for receiving the breakable glass bottle containing the temperature sensitive product; shape-retaining crushable structure extending between the filling structure receptacle and the insulated body and defining a peripheral cushion space extending about the receptacle; and a resilient insulated shock absorbing cover adapted to engage into the open end of the insulated body, and to receive embedded therein an upwardly extending neck portion of the glass bottle.

According to another aspect, the present invention provides a method of transporting a temperature sensitive product in a breakable glass bottle, the method comprising steps of: providing a shock absorbing insulated shipping container by providing an external box; providing an insulated body received into the box, the insulated body having a cavity defining an opening; providing a shock absorbing filling structure received into the cavity and defining at least one vertically extending receptacle for receiving the breakable glass bottle containing the temperature sensitive product; providing a shape-retaining crushable structure extending between the filling structure receptacle and the insulated body and defining a peripheral cushion space extending about the receptacle.

Other objects and features of the present invention will become apparent from consideration of the following description taken in conjunction with the accompanying drawings.

BRIEF DESCRIPTION OF THE DRAWING FIGURES

DETAILED DESCRIPTION OF THE PREFERRED EMBODIMENTS

Figure 1:
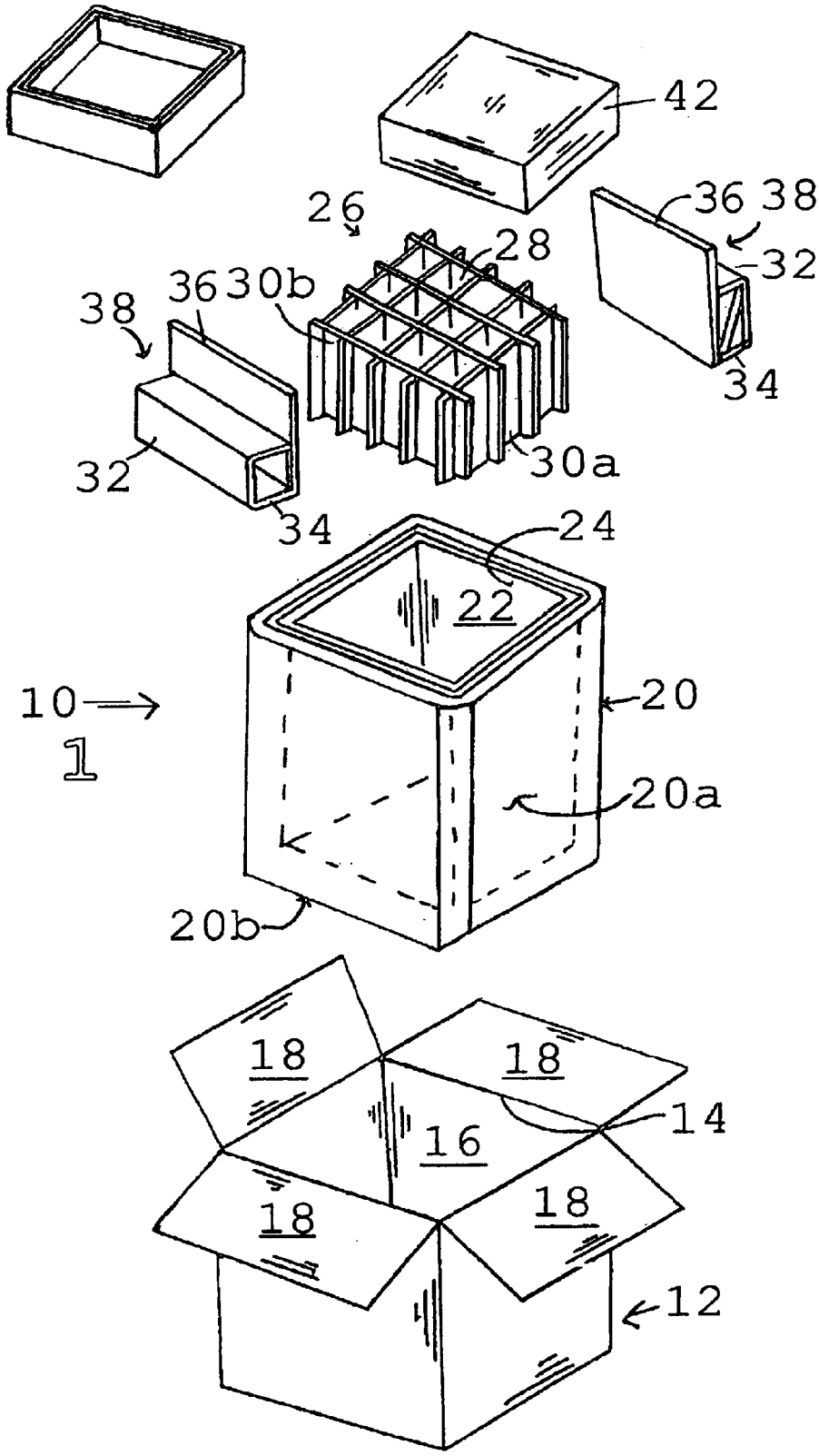
FIG. 1 is an exploded perspective view of a first preferred embodiment of a shock absorbing insulated shipping container in accordance with the present invention.

Turning now to the drawings, considering FIGS. 1–6 in conjunction, and giving attention first of all to FIG. 1, this Figure shows a shock absorbing, insulated shipping container 10 in accordance with the present invention. The container 10 generally includes an exterior cardboard shipping container or box 12, defining an upper opening 14, leading to a rectangular prismatic cavity 16, and the opening 14 of which may be closed by plural flaps 18 integral with the box 12 (the bottom of the box 12 being closed by other flaps, not seen in the drawing Figures, but which are conventional in the pertinent art).

Received into the cavity 16 of box 12 is a substantially rectangular and chambered, prismatic insulted body 20, which is rectangular in plan view, and matching in shape and size to the plan view shape of opening 14 and cavity 16. The insulated body 20 is also substantially the same height as the cavity 16 (see FIG. 3) so that it substantially fills the cavity 16. Insulated body 20 is preferably formed of foamed polyurethane material sheathed internally and externally with plastic film, and defines insulative side walls 20*a*, and an insulated bottom wall 20*b* (again, viewing FIG. 3). The side walls 20*a* and bottom wall 20*b* cooperatively define an insulated cavity 22 which is substantially rectangular and prismatic. The cavity has an upper opening 24 cooperatively defined by the side walls 18*a*, and which also substantially rectangular and the same size and shape in plan view as is the cavity 22.

Received into the cavity 22 via the opening 24 is a multi-part shock absorbing filling structure, generally referenced with the numeral 26. This structure 26 is essentially a shape-retaining, but also yieldable, grid structure providing plural vertically extending receptacles 28 for individually receiving glass bottles or other containers, as will be further explained. The structure 26 is preferably formed from corrugated cardboard (i.e., from paper board). The filling structure 26 as seen in FIG. 1, defines twelve (12) receptacles 28, which are arranged in a 3×4 array. However, it will be understood that the container 10 may define as few as a single receptacle, may define a number of receptacles between one and twelve, or may define a number of receptacles larger than 12. Also, while the presently disclosed preferred embodiment of the invention is especially sized and configured to receive filled wine bottles each of about 750 ml. volume, the invention is not so limited. That is, wine bottles of a smaller or larger size may be accommodated by the invention. Importantly, the receptacles 28 are sized to snugly receive the particular bottle size being shipped, so that the bottles are not loose or movable from side to side within the receptacles 28. Consequently, a given size of insulated body 20 with a given size of cavity 22 may be used to ship bottles of differing sizes by varying the size of the receptacles 28 defined by the filling structure 26 used within the shipping container. In each case, however, a peripheral cushion space (to be further explained) is maintained about the filling structure 26, spacing the receptacles 28 of this filling structure from the inside surface of walls 20*a*.

Further, bottles of another category (i.e., other then wine) may be accommodated by the invention. That is, bottles filled with medication, or with antibiotics, or with human or animal tissues (i.e., blood, plasma, sperm, or other tissue) may be accommodated by the present invention. Considering the filling structure 16 in greater detail, it is seen that the receptacles 28 are cooperatively defined by plural interlocked walls 30, with the first embodiment having five walls running in one direction, and being indicated with numeral 30*a*, and the four walls running perpendicularly in a second direction being indicated with the numeral 30*b*.

Importantly, the bottles to be received in receptacles 28 are most preferably glass and thus are frangible, and are filled with a relatively heavy liquid material to be shipped. That is, the weight of the liquid material may be several times the weight of the frangible glass bottles. Further, the bottles themselves may carry exterior labeling or other indicia that must be protected from scuffing or damage in shipping. Finally, the content of the bottles (i.e., whether wine, medicine or tissue, for example) may not be exposed to extremes of temperature during shipping or the contents will be damaged or destroyed. Further, although the present inventive shipping container is especially arranged, configured, and constructed to accommodate glass bottles, and to protect these glass bottles during shipping by providing shock absorption, while also providing a temperature regulated environment to protect and preserve the contents of the bottles, the invention is not so limited. In other words, the present invention may be used to ship temperature sensitive materials that are in bottles made of plastic, or which are not in bottles at all. That is, material to be shipped could be packed in individual shipping containers each inserted into a respective receptacle 28 of the shipping container 10. These individual shipping packages or containers may themselves be made of glass, plastic, paper, wax, fiberglass, or a variety of other materials. In each case, the container 10 will provide both shock absorbing protection to the containers being shipped, and temperature protection to the material in those containers or packages.

Along one or each opposite side of the 3×4 array of receptacles 28, along a side having four receptacles 28 of the filling structure 26 in a row, extends an elongate protective, somewhat L-shaped support structure 32, also formed of corrugated cardboard. Each support structure 32, includes a base section 34, and an upstanding wall section 36, and this wall section 36 in cooperation with the adjacent side wall 20*a* of the insulated body 20 provides an elongate trough 38 for receiving and protecting a temperature regulating gel pack 40 (best seen in FIGS. 2 and 3).

Finally, the container 10 includes a resilient plug member 42 formed of insulating, elastically yieldable, foam material, and which is sized to be received snuggly into the opening 24 of the insulated body 20. As will be seen however, the plug member 42 is more than merely an insulating member. That is, this plug member receives (i.e., at least partially embedded therein) a neck portion of the bottles received into receptacles 28 and contributes to shock absorbing for these bottles in conjunction with the filler structure 26.

Figure 2:
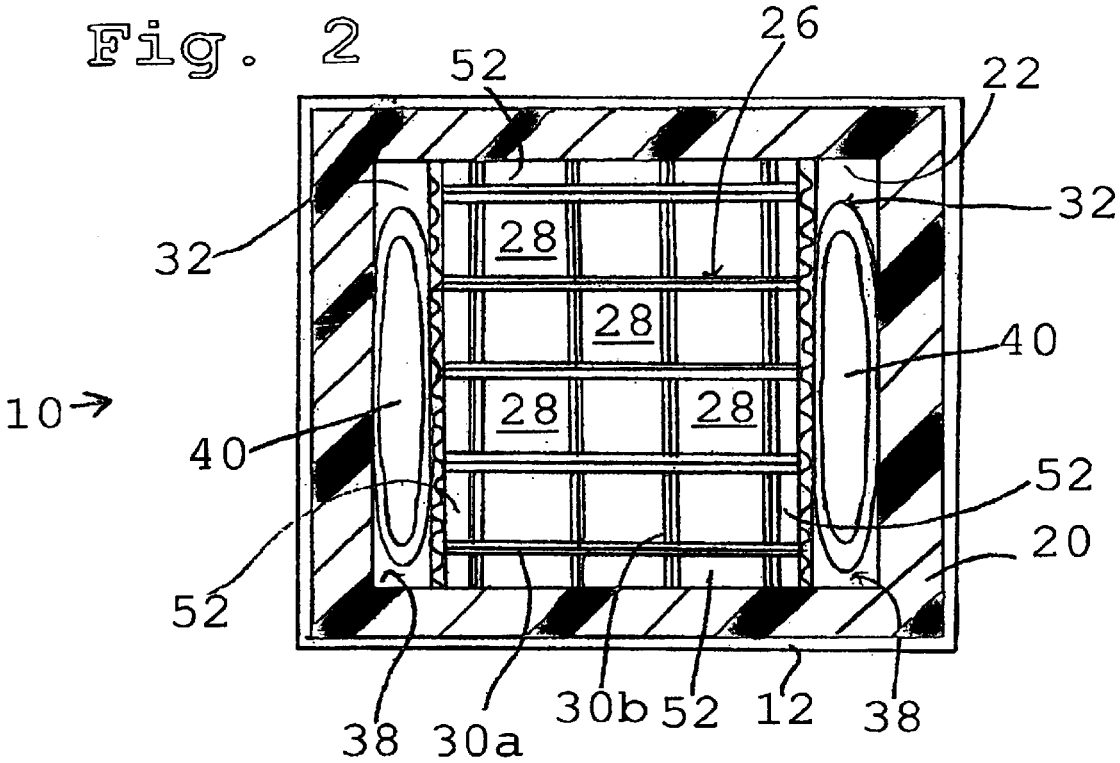
FIG. 2 is a plan view of the container seen in FIG. 1, but also shows bottles inserted into cavities of the container, and temperature control gel packs inserted into recesses of the container, both in preparation to closing the container for shipping.

Turning now to FIG. 2, it is seen that the container 10, in preparation for shipping of twelve filled wine bottles (generally indicated at 44) is opened, and the plug member 42 is temporarily removed. Each of the twelve filled wine bottles are then placed individually into a receptacle of the filler structure 26. One or more gel packs 40 are then placed into each of the troughs 38, and the plug member 42 is placed into the cavity 22 at opening 24. As the plug member is forcefully placed into the opening 24, the neck of each of the wine bottles 44 embeds partially into this resilient plug member (see FIG. 3).

Figure 4:
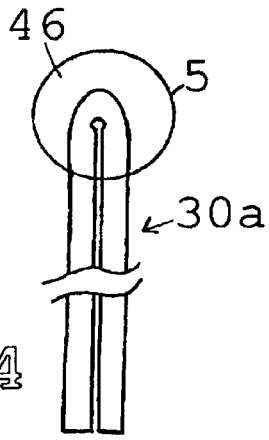
FIG. 4 is an enlarged fragmentary cross sectional view through the container of FIG. 3, taken along line 4—4.
Figure 5:
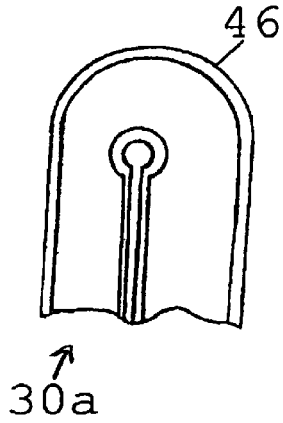
FIG. 5 is an enlarged fragmentary cross sectional view of an encircled portion of the container of FIG. 4.

Turning now to FIGS. 4 and 5, an enlarged fragmentary view shows an upper portion of one of the plural interlocked walls 30 of the filler structure 26. As is seen in FIG. 5, these walls are each made of a doubled sheet of corrugated cardboard (i.e., 48*a* for walls 30*a*, and 48*b* for walls 30*b*). This doubled sheet of corrugated cardboard is folded back on itself at its upper extent to form a rounded upper edge 46 for each of the walls 30. In other words, each of the walls 30 has a rounded upper edge 46, and is made of a respective doubled sheet of corrugated cardboard folded back double on itself. The rounded upper edge 46 is important for the use of the container 10 in which fine wine is shipped in the container because fine wine collectors value not only the wine within a bottle, but the condition of the bottle itself, including the condition of the original vintner's label. Thus, the rounded edge 46 is important to prevent scuffing of the labels on bottles of fine wine when these bottles are placed into the receptacles 28. Further, doubling of the walls 30*a* and 30*b* (i.e., by folding sheets 48*a* and 48*b*, respectively, double on themselves, is important because it gives the walls 30*a* and 30*b* a requisite level of strength to resist shifting of the bottles in opposition to shocks and other forces that may be encountered during shipping, but also provides a required level of yielding and compliance such that deformation of these walls cushions the bottles during shocks applied to the container 10.

Figure 6:
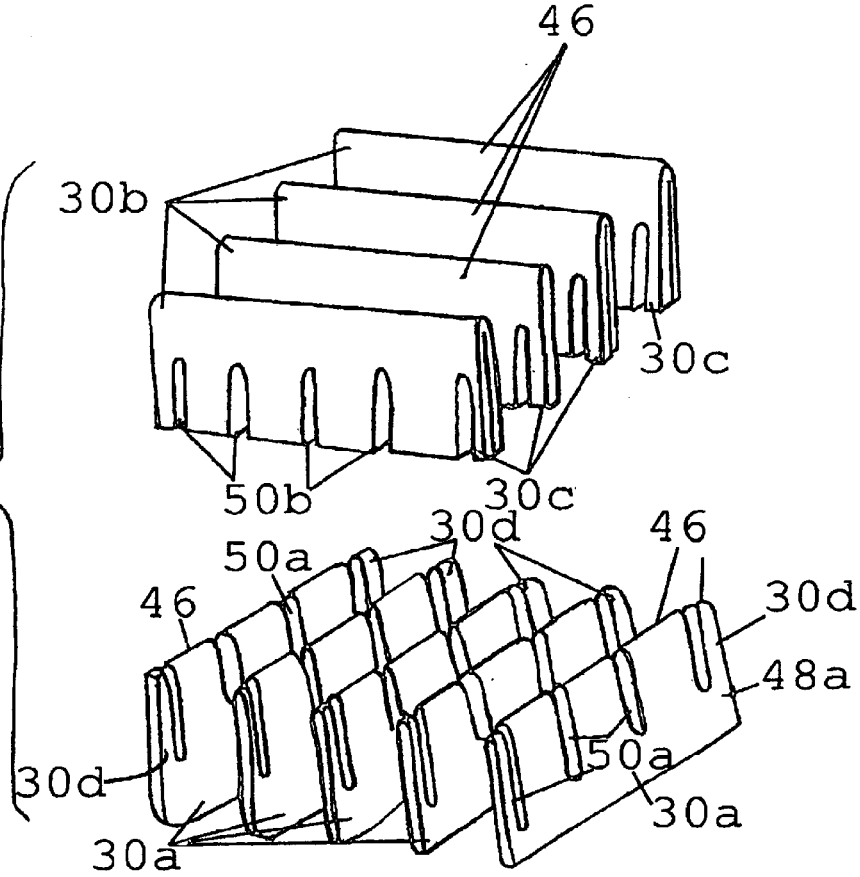
FIG. 6 is an exploded perspective view of a portion of the shock absorbing insulated shipping container seen in FIG. 1.

As is best seen in FIG. 6, in order to define the twelve receptacles 28, each as an element in a 3×4 array, the filler structure 26 includes five walls 30*a* running parallel to one another in a first direction, and four walls 30*b* extending parallel to one another in a second direction perpendicularly to the walls 30*a*. That is, in each direction of the 3×4 array of receptacles 28, the filling structure 26 includes a number of walls that exceeds the number of receptacles in that direction by one. Thus, each receptacle is bounded on each side by one of the walls 30*a* or 30*b*. The walls 30*a* each define four vertical slots 50*a* extending from an upper edge (i.e., the rounded folded edge 46) of the respective wall about half way to the lower extent of each of these walls. It is to be noted that the two outer slots 50 are close to but spaced a determined peripheral cushioning distance (to be further explained) from the end edges of these walls. Similarly, the walls 30*b* each define five vertical slots 50*b* extending from a lower edge (i.e., the edge having two free cardboard edges of the respective sheet 48*b* adjacent to but not immediately attached to one another) of the respective wall 30*b* about half way to the upper edge (i.e., about half way to the folded and rounded upper edge 46) of each of these walls. It is to be noted that the two outer slots 50*b* are close to but are also spaced a determined cushioning distance (to be further explained) from the end edges of these walls.

Continuing with a consideration of FIG. 1, and viewing also FIG. 2, it is seen that the end edges 30*c* of each of the walls 30*b* confronts and is directly engageable onto a respective one of the side walls 20*a* of the insulated body 20 within cavity 22. On the other hand, each of the end edges 30*d* of the walls 30*a* confronts and is engageable on the upstanding wall portion 36 of the L-shaped support structure 34. Thus, the walls 30*a* are separated from the troughs 38 by the wall portion 36. Further, it is seen that the lower base section 34 of the support structures 32 also support the walls 30*a* in spaced relation away from the side walls 20*a* of the insulated body, and define and maintain the troughs 38. Still further, it is seen that the filling structure 26 maintains a peripheral cushion space or distance 52. That is, this peripheral cushion space 52 extends completely about the perimeter of the filling structure 26. This peripheral cushioning space or distance 52 is essentially of the same dimension by which the outer pair of slots of each of the walls 30*a* and 30*b* is spaced from the end edges of these walls, and is the distance by which the outer ones of the walls received into those slots are spaced from the interior of the cavity 22 or from the upstanding wall 36 of the support structure 32. Stated differently, each of the walls 30*a* and 30*b* has an end protrusion protruding beyond the outermost of the perpendicular walls, and this end protrusion extends toward and confronts and is engageable with either the inner surface of the cavity 22 (i.e., for walls 30*b*) or the upstanding wall 36 (i.e., for walls 30*a*) of the support structure 32. These protruding end portions are each somewhat crushable in response to applied shock loads, so that an additional element of crushable structure and shock energy absorption is provided by the filling structure 26.

Returning now to further consideration of FIG. 6, it is seen that the nature of the interlocking of walls 30*a* and 30*b* is chosen with a view to the fact that the 3×4 array of bottles in receptacles 28 has a greater weight in the four-bottle direction of the array than it does in the three-bottle direction of the array. That is, in the direction having 4 bottles in a row, the walls 30*a* and 30*b* interlock, with approximately a lower one-half of each of the walls 30*a* being supported somewhat rigidly by the perpendicular walls 30*b*. This is a recognition that a filled glass bottle, and particularly a filled wine bottle, has most of its weight of liquid fill low in the bottle. Conversely, the upper portion of the walls 30*a* is somewhat more flexible because these walls can bend above the top of the slots 50*b*. On the other hand, and conversely, the direction of the 3×4 array of receptacles that has 3 bottles in a row has the lower one-half of each wall some what flexible because it is extending below the bottom of the slots 50*a* in the walls 30*a*. These lower wall parts are more flexible and do not provide the same degree of support and compliance as do the lower parts of walls 30*a*. However, the direction of the array having 3 bottles in a row is also cushioned against shocks in that direction by the presence of the support structure 32 extending along those sides of the filling structure 26. This support structure 32 is also a somewhat crushable and shock energy absorbing structure, as will be further explained.

Figure 3:
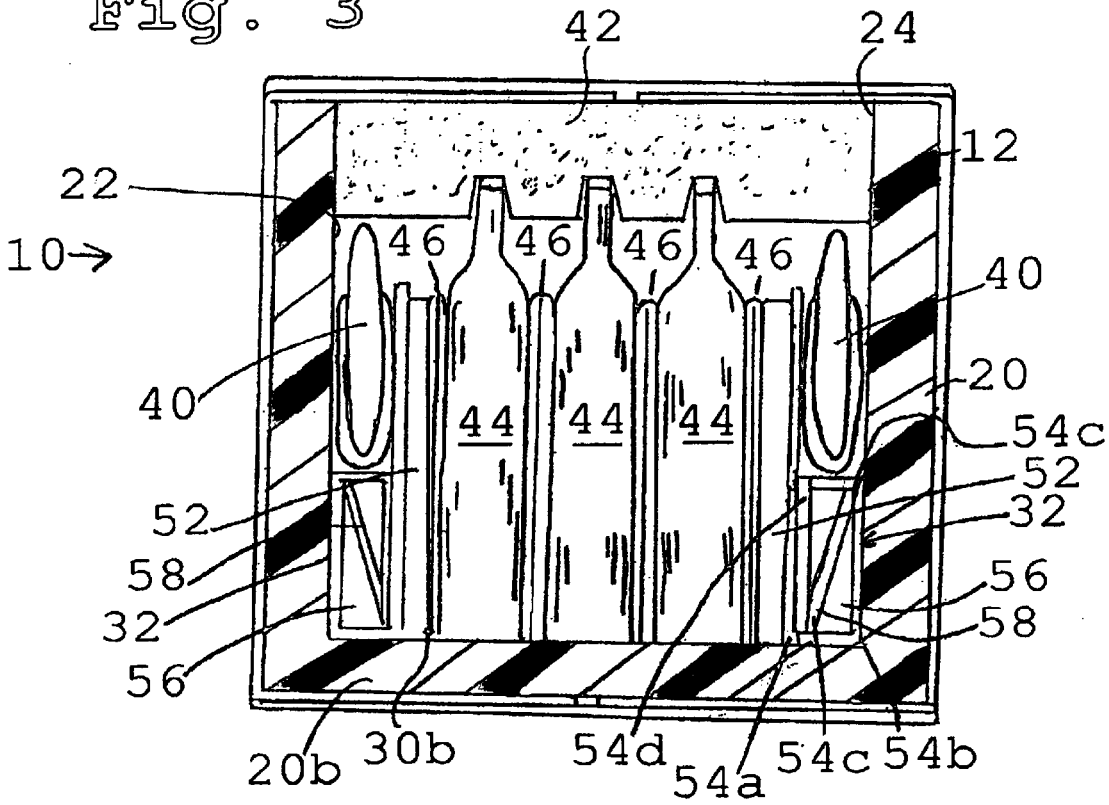
FIG. 3 is a perspective view of the container of FIG. 2 with the container closed for shipping, and with a portion of the container cut away for clarity of illustration.

Viewing FIG. 3 in some detail, it is seen that the base section 34 of the support structure 32 is formed by making five spaced apart folds (indicated on FIG. 3 with the reference characters 54*a* through 54*g*) in the lower portion of a sheet of corrugated cardboard that is to become the support structure 32. These first four folds, when the adjacent sections of cardboard are disposed at 90 degrees, make a rectangular box section indicated on FIG. 3 with the arrowed numeral 56. The fifth fold 54*g* provides a diagonal wall 58 which extends across the box section 56 from corner to corner. The distal end of the section of cardboard extending from fold 54*g* nests into the fold at 54*c*. This diagonal wall 58 both provides support to the box section 56 (and to the upstanding wall section 36) to oppose shocks directed along the 3-bottle direction of the array of receptacles 28, and it also provides the box section 56 with a controlled crush resistance or compliance. Thus, the support structure 32 not only protects the gel packs 40 against perforation by a protruding end edge of one of the walls 30*a*, it provides a controlled crushability for the filling structure 26 in order to cushion shocks. Stated again, and importantly, in the event of shock being applied to the container along the 3-bottle direction of the 3×4 array of filling structure 26, the cushion space 52 may be taken up by shifting of the bottles in the receptacles 28. However, the gel packs 40 are protected against being perforated by an end edge of one of the walls 30*a* by the interposed upstanding wall section 36. Thus, the labels of fine wine bottles are not likely to be soiled or ruined by leaking material from a perforated gel pack.

The result of the structure described above is that the shipping container 10 meets ISTA (International Safe Transport Association) drop tests for the various sizes of the contain 10 ranging from a one bottle size (see the alternative embodiment described below) to the size described immediately above which holds a case (i.e., 12) filled wine bottles. In fact, the container 10 passes this test twice over. This drop test involves dropping the subject container from a height that varies in dependence on the weight of the container onto various corners, edges, and surfaces of the shipping container. This drop sequence starts with a drop onto the lower seamed corner (one drop), and then follows with a drop onto each of the three edges radiating from this seamed corner (one drop each edge, total of four drops), followed by a drop onto each face of the container (one drop each face, six faces, total of ten drops for the entire test sequence). Further, this container 10 successfully passes the ISTA 2-day Summer Test, and also passes the Modified (i.e., 3-day) Summer Test, which is a three-day test with the internal temperature of the container not to exceed 70° F. while outside temperatures are varied to simulate both day-time high and night time lower temperatures expected during truck shipment in a hot portion of the country (i.e., Southwestern US temperatures). Actually, the shipping container 10 is probably acceptable for shipping fine wines in summertime conditions over a trip interval as long as five days. Still further, the present shipping container 10 is able to be used in winter conditions by warming the gel packs 40 in a microwave to about 120° F. before insertion into the container for shipping. These warm packs will prevent freezing of the wine shipped in the container 10, and also do not result in the temperature of the wine becoming too high during the early part its journey to a destination.

Figure 7:
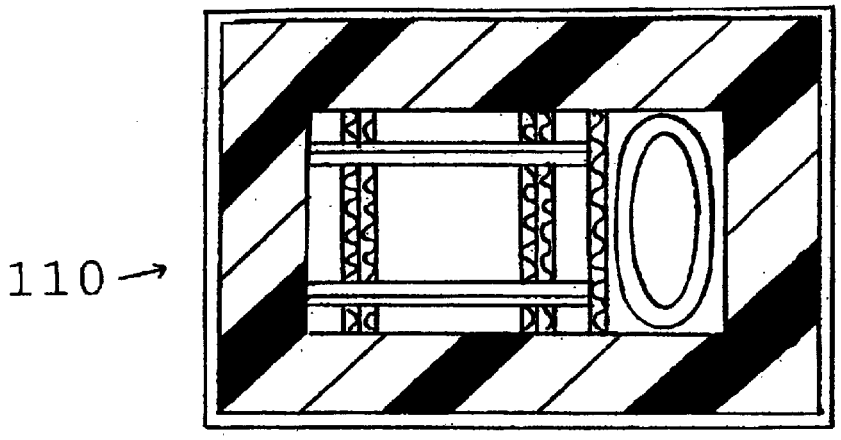
FIG. 7 is a plan view similar to that of FIG. 2, but showing an alternative embodiment of the shipping container according to this invention.
Figure 8:
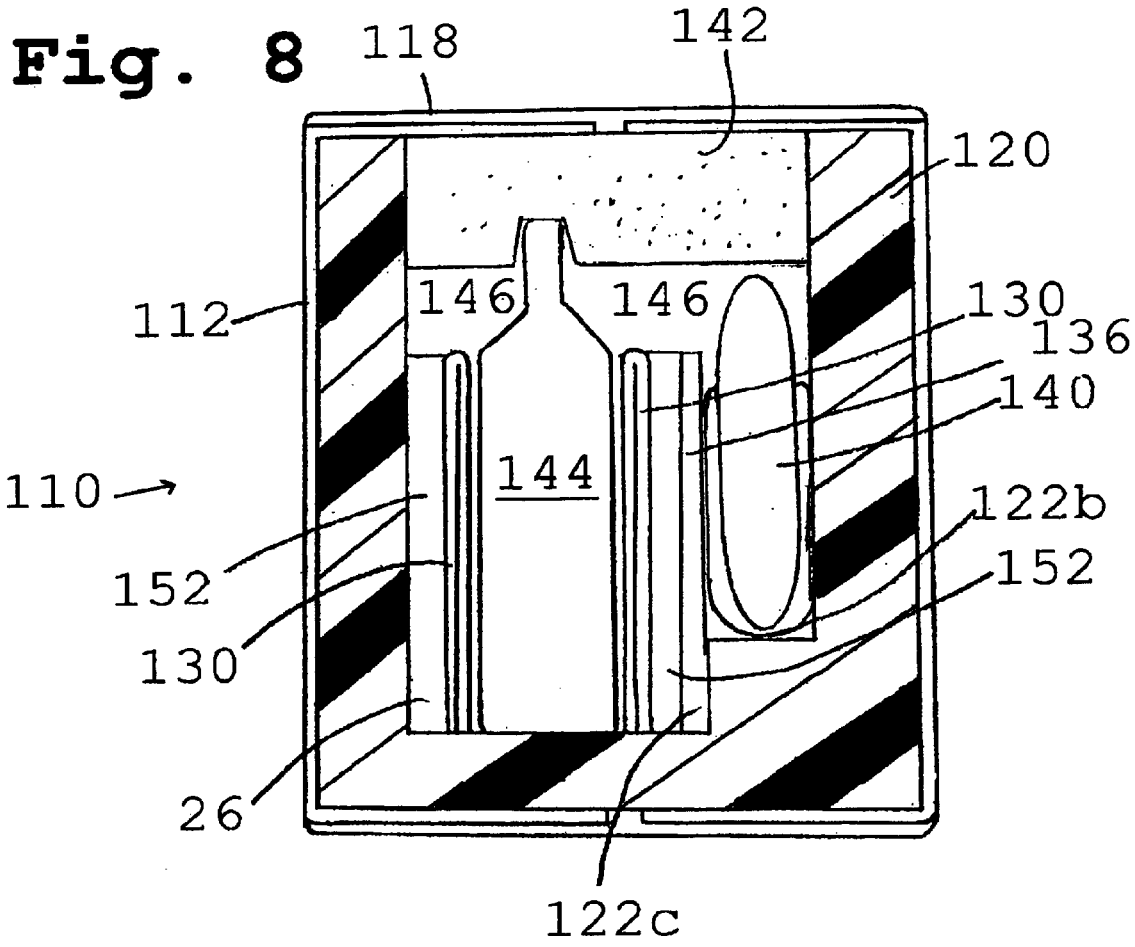
FIG. 8 is an elevation view, partially in cross section, taken at line 8—8 of FIG. 7.

Turning now to FIGS. 7 and 8, a second preferred (single bottle) embodiment of an insulated shipping container 10 in accordance with the present invention is shown. Because this second embodiment shares many features and structures in common with the first embodiment described above, these features are indicated on FIGS. 7 and 8 with the same numeral used above, and increased by one-hundred (100). Viewing FIGS. 7 and 8 in conjunction, it is seen that a shock absorbing, insulated shipping container 110 in accordance with a second embodiment of the present invention includes an exterior cardboard shipping container or box 112, defining an upper opening 114, leading to a rectangular prismatic cavity 116. The opening 114 may be closed by plural flaps 118 integral with the box 112. Received into the cavity 116 of box 112 is a substantially rectangular and chambered, prismatic insulted body 120, which is rectangular in plan view, and matching in shape and size to the plan view shape of opening 114 and cavity 116.

The insulated body 120 is also substantially the same height as the cavity 116 so that it substantially fills the cavity 116. This insulated body defines insulative side walls 120*a*, and an insulated bottom wall 120*b* cooperatively defining an insulated cavity 122. While the cavity 122 is substantially rectangular and prismatic, in this case it is also stepped to provide a well portion 122*a* receiving a bottom portion of a wine bottle, and a trough portion 122*b* for receiving a refrigerant gel pack. The cavity has an upper opening 124 cooperatively defined by the side walls 120*a*, and which also substantially rectangular and the same size and shape in plan view as is the cavity 122.

Received into the cavity 122 via the opening 124 is a multi-part shock absorbing filling structure referenced with the numeral 126. Again, this filling structure 126 is essentially a shape-retaining, but also yieldable grid structure providing in this case a single vertically extending receptacle 128 for individually receiving a glass bottle or other containers. The structure 126 is preferably formed from corrugated cardboard, and the receptacle 128 is cooperatively defined by plural (i.e., in this case, four) interlocked walls 130.

Again, this embodiment of the present inventive shipping container is especially arranged, configured, and constructed to accommodate a glass bottle, and to protect this glass bottle during shipping by providing shock absorption, while also providing a temperature regulated environment to protect and preserve the contents of the bottle. The shipping container 110 will provide both shock absorbing protection to the container being shipped, and temperature protection to the material in those containers or packages. Again, to accomplish this objective, along each side of the grid provided by the filling structure 126 (that is on each side of the receptacle 128), the filling structure 126 provides a cushion space 152. In this embodiment, there is no L-shaped support structure 32, but instead, the insulated body 120 defines a step 122*c*. Disposed against this step is an upright wall 136 made of a sheet of cardboard. Thus, the protruding end wall portions of the walls 130*a* and 130*b* extend toward, confront, and are engageable with either the inner surface of the side walls 120*a* of the insulated body 120, or against the wall 136. Accordingly, the filling structure 126 provide the same nature of protection, support and crushable shock absorption function that was described above with respect to the first embodiment of the invention. As before, the wall 136 protects a gel pack 140, and prevents this gel pack from being torn or perforated by an end portion of one of the walls 130*a* or 130*b* (in this case, since the array of filling structure 126 has only a unity receptacle, it makes no difference which way the filling structure 126 is inserted into the cavity 122—with walls 130*a* running toward the wall 136, or with the walls 130*b* running in that direction).

Again, considering FIG. 8 for a moment, it is seen that the container 110, in preparation for shipping of the single filled wine bottle 144 receives a plug member 142, which receives a portion of the neck of the bottle 144 embedded therein when the container 110 is closed.

It is important to understand that the plug members 42 and 142 in addition to assisting in cushioning shocks directed in the horizontal directions, essentially by themselves cushion shocks directed in the upward vertical direction (i.e., the drop test includes dropping the shipping container in an inverted position on its top, so the shock vector is from bottom to top as the container 10 or 110 is seen in the drawing Figures). Further, it is to be noted that for shocks directed along horizontal directions of the containers 10 and 110, the filling structure 26 or 126 provides a desired level of support, and a concomitant desired level of crushing shock absorption. Finally, it is to be noted that for shocks directed downward (that is, from dropping the shipping container on its bottom) there is no cushioning or crushing shock absorption structure needed or provided (other than that provided inherently by the box 12, and insulated body 20). This is because experience has shown that glass bottles and particularly glass wine bottles are well able to withstand shocks in this direction due to their own strength.

While the invention is susceptible to various modifications, and alternative forms, specific examples thereof have been shown in the drawings and are herein described in detail. It should be understood, however, that the invention is not to be limited to the particular forms disclosed, but to the contrary, the invention is to cover all modifications, equivalents and alternatives falling within the spirit and scope of the appended claims. For example, it is apparent that the walls 30 of the filling structure 26 could be made of a multi-layer or multi-ply corrugated cardboard material, so that instead of a single sheet of single-ply cardboard folded double on itself, a single layer of a thicker cardboard would be used to make the walls 30. Also, in order to protect the bottles and their labels from being scuffed when being placed snuggly in to the receptacles 28 of a filling structure so made, the upper edge of the walls 30 could be protected by tape, or a thin plastic U-shaped extrusion could be slipped over the raw edge of the multi-ply cardboard to protect the bottles and their labels from this edge. In each case, however, the peripheral cushion space 52 will need to be maintained and preserved, because it is this space and the controlled crushability of the end sections 30*c* and 30*d* of the walls 30 that provides the essential crushability and cushioning of the bottles allowing the delicate contents of this shipping container to survive possible mishaps during carriage by a common carrier.

I claim:

1. An insulated and shock absorbing shipping container comprising:

a shape retaining insulated body formed of expanded polyurethane foam, said insulated body having a bottom wall and plural side walls cooperatively defining a cavity, and said side walls defining an opening to said cavity, a shape retaining and also yieldable and crushable filling structure received into said cavity, said filling structure including a grid of interlocking walls cooperatively defining an array of plural parallel receptacles extending between said bottom wall and said opening, and said filling structure including cushioning and spacing structure extending outwardly there from toward said side walls of said insulated body, said cushioning and spacing structure defining a cushioning space extending about said array of plural receptacles;

wherein said filling structure includes a first plurality of substantially similar walls extending in a first direction, and a second plurality of substantially similar walls extending in a second direction substantially perpendicularly to said first direction, and said first plurality of walls and said second plurality of walls interlocking with one another to form a shape retaining grid of walls, and said spacing structure including each of said first and said second plurality of walls including an outwardly extending end portion disposed outwardly of said array of receptacles and extending toward a side wall of said insulated body, and said end portions of said first and second plurality of walls each being shape retaining and each also being selectively crushable to absorb shock;

wherein said container also includes within said cavity alongside of said filling structure a support structure forming in cooperation with an adjacent side wall of said insulated body a trough for receiving a temperature control pack, and said support structure including an upstanding wall section confronting and engaged by end portions of one of said first plurality and said second plurality of walls, whereby said upstanding wall section is interposed between said end portions of said walls and a temperature control pack placed in said trough.

2. The insulated shipping container of claim 1, wherein said support structure includes a piece of corrugated cardboard folded on itself to form a box section disposed in a lower extent of said cavity and upward from which extends paid upstanding wall section.

3. The insulated shipping container of claim 2, wherein said support structure box section is shape-retaining and also is crushable to cushion shock.

4. The insulated shipping container of claim 3, wherein said box section of said support structure includes an internal wall portion extending across said box section at a diagonal in order to achieve a controlled crushability for said box section.

5. The insulated shipping container of claim 1, wherein each of said first plurality of walls and of said second plurality of walls is formed of a piece of corrugated cardboard folded double on itself at an upper extent thereof so as to provide an upwardly disposed rounded edge for each of said plurality of walls.

6. An insulated and shock absorbing shipping container, especially for shipping fine wine in breakable and delicate glass bottles, for preventing external scuffing of the bottles and their labels, for preventing breakage of the bottles in transit, and for maintaining the wine within a predetermined temperature range during transit, said shipping container comprising:

an external cardboard box defining an upwardly disposed opening to an internal space having a height dimension, and said box including flaps for closing said opening;

a chambered insulated body formed of foamed polymer which is shape retaining and only slightly yieldable, said insulated body including a bottom wall, and plural side walls having a height dimension substantially matching the height dimension of said internal space, and said side walls and bottom wall cooperatively defining a cavity within said insulated body, and said side walls defining an upwardly disposed opening matching said cavity in plan view, said insulated body being slidably received into said cardboard box;

a filling structure slidably received into said cavity and having a grid of vertically and horizontally extending walls interlocking to define at least one vertically extending receptacle for receiving a delicate and breakable glass bottle containing fine wine;

said filling structure including a peripheral shape-retaining crushable structure portion extending between said receptacle thereof and said insulated body and defining a peripheral cushion space extending about said receptacle; and a shape retaining and resilient insulated cover member adapted to engage into the open end of the insulated body, and to receive embedded therein an upwardly extending neck portion of the glass bottle;

further including a trough for receiving a temperature control pack, said trough being defined along one side of said filling structure, and an upstanding wall section interposed between said filling structure and said trough so at to protect said temperature control pack from perforation or tearing by said filling structure.

7. The shock absorbing and insulated shipping container of claim 6 wherein said filling structure includes a support member received in said cavity and defining said trough and including said upstanding wall section.

8. The shock absorbing and insulated shipping container of claim 7 wherein said support member includes a base portion defining a box section extending within said cavity along side of said filling structure.

9. The shock absorbing and insulated shipping container of claim 7 wherein said base section includes a diagonal wall extending alongside of said filling structure, and said base portion having a controlled crushability to further cushion shock applied to said shipping container.

* * * * *